US007559519B1

(12) United States Patent
Dragic et al.

(10) Patent No.: US 7,559,519 B1
(45) Date of Patent: Jul. 14, 2009

(54) STUD BRACKET FOR SUPPORTING REINFORCING MEMBERS IN A WALL STRUCTURE

(75) Inventors: Milan Dragic, Wake Forest, NC (US); Michael L. Torres, Raleigh, NC (US)

(73) Assignee: The Steel Netork, Inc., Raleigh, NC (US)

( * ) Notice: Subject to any disclaimer, the term of this patent is extended or adjusted under 35 U.S.C. 154(b) by 175 days.

(21) Appl. No.: 11/493,776

(22) Filed: Jul. 26, 2006

(51) Int. Cl.
*A47H 1/10* (2006.01)

(52) U.S. Cl. ..... 248/300; 248/216.1; 52/702; 52/712

(58) Field of Classification Search ..... 248/216.1, 248/906, 300, 216.4, 217.2, 217.3, 218.2, 248/218.3; 52/702, 712, 714, 715; 403/232.1, 403/233
See application file for complete search history.

(56) References Cited

U.S. PATENT DOCUMENTS

| | | | | | |
|---|---|---|---|---|---|
| 2,191,979 | A * | 2/1940 | Bierbach | 52/370 |
| 2,994,001 | A | 5/1958 | Black | |
| 2,895,186 | A * | 7/1959 | Franks | 403/172 |
| 2,914,148 | A * | 11/1959 | Bock | 52/712 |
| 3,256,030 | A * | 6/1966 | Banse | 403/400 |
| 4,007,570 | A | 2/1977 | Hunter | |
| 4,453,362 | A | 6/1984 | Rodgers | |
| 4,572,695 | A * | 2/1986 | Gilb | 403/232.1 |
| 4,658,556 | A | 4/1987 | Jenkins | |
| 4,703,593 | A | 11/1987 | Smolik | |
| 4,717,101 | A | 1/1988 | Harrod | |
| 4,982,927 | A * | 1/1991 | Zajeski et al. | 248/674 |
| 5,150,982 | A * | 9/1992 | Gilb | 403/232.1 |
| 5,189,857 | A | 3/1993 | Herren et al. | |
| 5,217,317 | A * | 6/1993 | Young | 403/232.1 |
| 5,249,400 | A | 10/1993 | Turner | |
| 5,380,116 | A * | 1/1995 | Colonias | 403/232.1 |
| 5,481,844 | A * | 1/1996 | Kajita | 52/702 |
| 5,697,725 | A * | 12/1997 | Ballash et al. | 403/231 |
| 6,189,277 | B1 | 2/2001 | Boscamp | |
| 6,253,529 | B1 | 7/2001 | De Boer | |
| 6,260,318 | B1 | 7/2001 | Herren | |
| 6,295,781 | B1 * | 10/2001 | Thompson | 52/712 |
| 6,560,943 | B1 * | 5/2003 | Leek et al. | 52/715 |
| 6,662,517 | B1 * | 12/2003 | Thompson | 52/714 |
| 6,705,056 | B2 | 3/2004 | Tollenaar | |
| 7,254,919 | B2 * | 8/2007 | Lutz et al. | 52/92.2 |

* cited by examiner

*Primary Examiner*—Amy J. Sterling
(74) *Attorney, Agent, or Firm*—Coats & Bennett, P.L.L.C.

(57) ABSTRACT

A stud bracket is provided and adapted to be secured to a stud in a wall structure. The stud bracket includes a stud receiver having a pair of spaced apart members that define a stud receiving area. In use, a respective stud is inserted into the stud receiving area and the stud receiver is secured to the stud. Extending outwardly from the bracket, on each side, is a holder for receiving and holding an end portion of a reinforcing member. When a series of brackets are secured to a series of studs in a wall structure, a series of reinforcing members are provided in the wall structure with each reinforcing member being supported on one end portion by a holder associated with one bracket, and on the other end portion by another holder associated with another bracket. Hence, when used, the stud brackets support a series of reinforcing members that extend generally between pairs of respective studs of a wall structure.

16 Claims, 11 Drawing Sheets

STUD BRACKET FOR SUPPORTING REINFORCING MEMBERS IN A WALL STRUCTURE

FIELD OF THE INVENTION

The present invention relates to wall structures, and more particularly to a bracket or clip that attaches to a stud and receives and supports an end portion of a reinforcing member that forms part of a wall structure.

BACKGROUND OF THE INVENTION

Wall structures are typically constructed of a series of spaced apart studs, metal or wooden, and drywall or other interior surface material secured to the interior surfaces of the studs. In various places within a building structure, such as adjacent steps, building codes require handrails. To support handrails on a wall structure, some form of reinforcement is generally required to be built into the wall structure behind the area where the handrail is attached. Drywall or interior boarding alone is generally insufficient to support the handrail as the loads normally exerted by humans on handrails have the potential to pull the handrail or a section thereof off the wall if the handrail itself is not secured to a reinforcing structure. However, placing handrail reinforcements in a wall is tedious and time consuming, especially if the reinforcing structure is adequately fixed to the studs.

Therefore, there has been and continues to be, a need for cost effective and easy to install handrail reinforcing systems.

SUMMARY OF THE INVENTION

The present invention relates to a stud bracket that is adapted to be attached to a stud and includes a stud receiver having a pair of spaced apart members that define a stud receiving are therebetween. Also forming a part of the bracket is a pair of holders with each holder projecting from one side of the bracket for receiving and holding end portions of a reinforcing member. When used in a wall structure, stud brackets are secured to two or more studs and a reinforcing member, such as a wooden board, is held by a holder associated with each bracket.

In addition, the present invention entails a wall structure having a series of spaced apart studs. A stud bracket is secured to two or more studs and comprises a stud receiver for receiving a stud. One or more reinforcing members is incorporated into the wall structure. To support the one or more reinforcing members, each stud bracket includes at least one holder that projects therefrom for receiving and holding an end portion of a reinforcing member. Hence, when incorporated into the wall structure, a reinforcing member will extend generally between two studs and be held or supported by the bracket attached to the two studs.

Other objects and advantages of the present invention will become apparent and obvious from a study of the following description and the accompanying drawings which are merely illustrative of such invention.

DESCRIPTION OF EXEMPLARY EMBODIMENTS

Figure 1A:
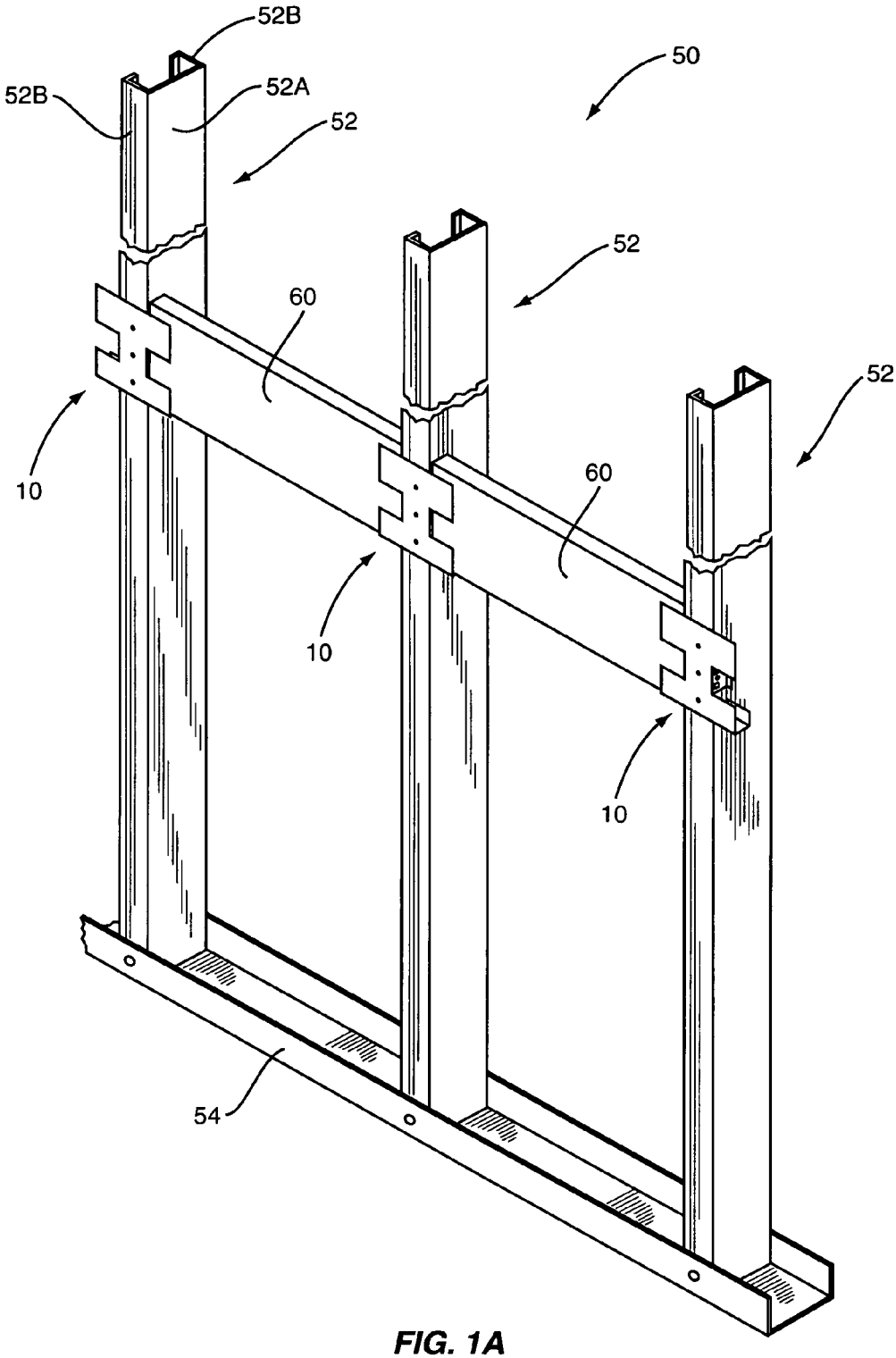
FIG. 1A is a perspective view of a portion of a wall structure including the bracket of the present invention.

With further reference to the drawings, particularly FIGS. 2A-5, the stud bracket of the present invention is shown therein and indicated generally by the numeral 10. As will be appreciated from subsequent portions of this disclosure, bracket 10 is adapted to be secured to a stud. When two brackets 10 are secured to consecutive studs, a reinforcing member can be inserted between the studs and supported by the brackets 10. The term "stud bracket" means a bracket that attaches to a stud that forms a part of the frame structure of a wall and where the stud supports wallboard, drywall, sheets of lath, etc.

Viewing the particular construction of the stud bracket 10, it is seen that the same includes a stud receiver indicated generally by the numeral 12. Stud receiver 12 defines a stud receiving area 13 that receives and holds a stud. Projecting outwardly from each side of the bracket 10 is a holder indicated generally by the numeral 14. Holder 14 functions to support, at least in part, an end portion of a reinforcing member. Extending above the stud receiver 12 is a transverse portion that is referred to as a first retainer 16. When the stud bracket 10 is secured to a stud, a portion of the first retainer 16 will rest adjacent one of the flanges of the stud. The term "stud receiver" means a structure that receives and extends at least partially around a stud that forms a part of the frame structure of a wall, and where the stud supports wallboard, drywall, sheets of lath, etc.

Figure 2A:
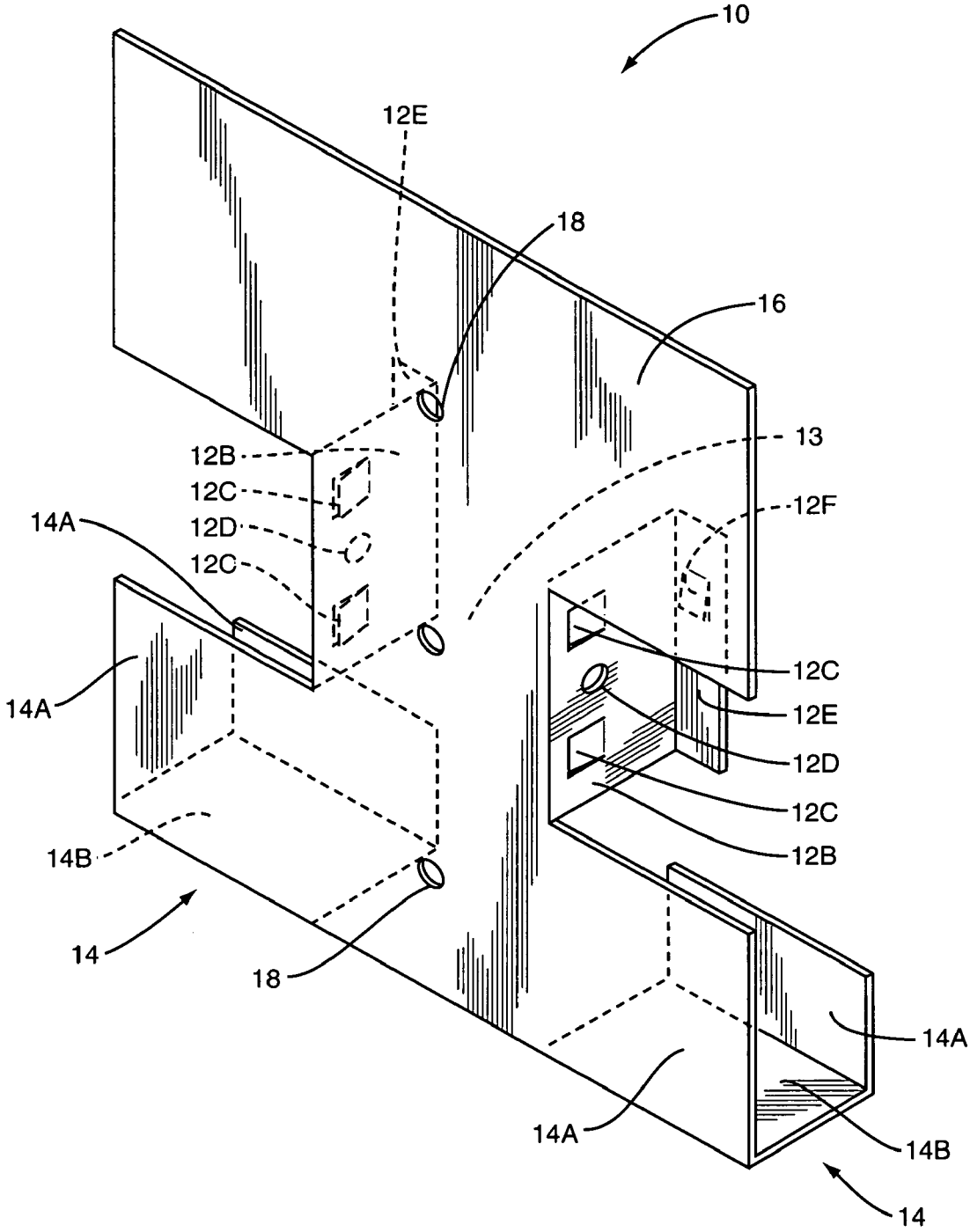
FIG. 2A is a perspective view for one embodiment of the stud bracket of the present invention.

Viewing stud receiver 12 in more detail, it is seen that the same comprises a generally U-shaped structure with the stud receiving area 13 being defined therein. With reference to FIG. 2A, the stud receiver 12 comprises a web portion 12A and a pair of flanges 12B. Together, the web 12A and flanges 12B form a generally U-shaped structure. The stud receiving area 13, referred to above, is generally bounded by the web 12A and the pair of spaced apart flanges 12B. Optionally, one or more resilient tabs 12C can be formed in each flange 12B. Note in FIGS. 2A-5 where each flange 12B includes a pair of resilient tabs 12C. Resilient tabs 12C are formed by cutting around a series of edges of each tab and bending the tab inwardly towards a stud receiving area 13. Thus, each tab 12C is resiliently biased away from an inner side of each flange 12B. Hence, when a stud is inserted into the stud receiving area 13, the tabs 12C will engage and generally press against opposed portions of the stud. The resulting resilient pressure will tend to grip or hold the bracket 10 onto the stud until one or more fasteners are screwed through the bracket 10 into the stud.

Extending from each flange 12B is a second retainer or flange 12E. Generally, the second retainer 12E extends normal to the adjacent flange 12B. Note in FIG. 2A where the second retainers 12E project outwardly from the respective flanges 12B. Like flanges 12B, the second retainers 12E can include resilient tabs 12F that are cut from the second retainer 12E and are bent towards the face of the bracket 10.

Turning to the holder 14, each holder includes a pair of flanges 14A connected by a web 14B. In the particular design shown in FIGS. 2A-5, for example, the front flange 14A is of a height slightly greater than the height of the rear or back flange 14A. The height of each of the flanges can vary. Note that a holder 14 projects from each side of the bracket 10. Flange 14A forms a part of the face of the bracket 10, and extends transversely across the entire bracket 10.

Each holder 14 cooperates with the second retainer 12E to hold and support one end portion of a reinforcing member 60. See FIGS. 1 and 2B. When an end portion of the reinforcing member 60 is inserted into the holder 14 it is appreciated that the flanges 14A and 14B tend to extend around a bottom portion of the reinforcing member 60. Furthermore, the upwardly spaced second retainer 12E will engage a portion of the back of the reinforcing member 60. The resilient tab 12F can even exert a force against the end portion of the reinforcing member 60 to hold the same securely within the bracket 10.

As seen in FIG. 2A, the bracket 10 includes a face that is of a generally I-shape. That is, the I-shape face is comprised of the upper retainer 16, web 12A of the stud receiver 12, and the front flanges 14A, and the structure extending between the flanges 14A. Formed generally centrally in the face of the bracket 10 is a series of fastener openings 18. Note in FIG. 2B, when the bracket 10 is secured to a stud, indicated generally by the numeral 52, that a series of fasteners 20 are extended through the fastener openings 18 into the adjacent flange 52B of the stud 52. Also note that the flanges 12B that form a part of the stud receiver 12 can be provided with fastener openings 12D. This permits a fastener to be extended through the fastener opening 12D and into the butt end of a reinforcing member 60.

Figure 2B:
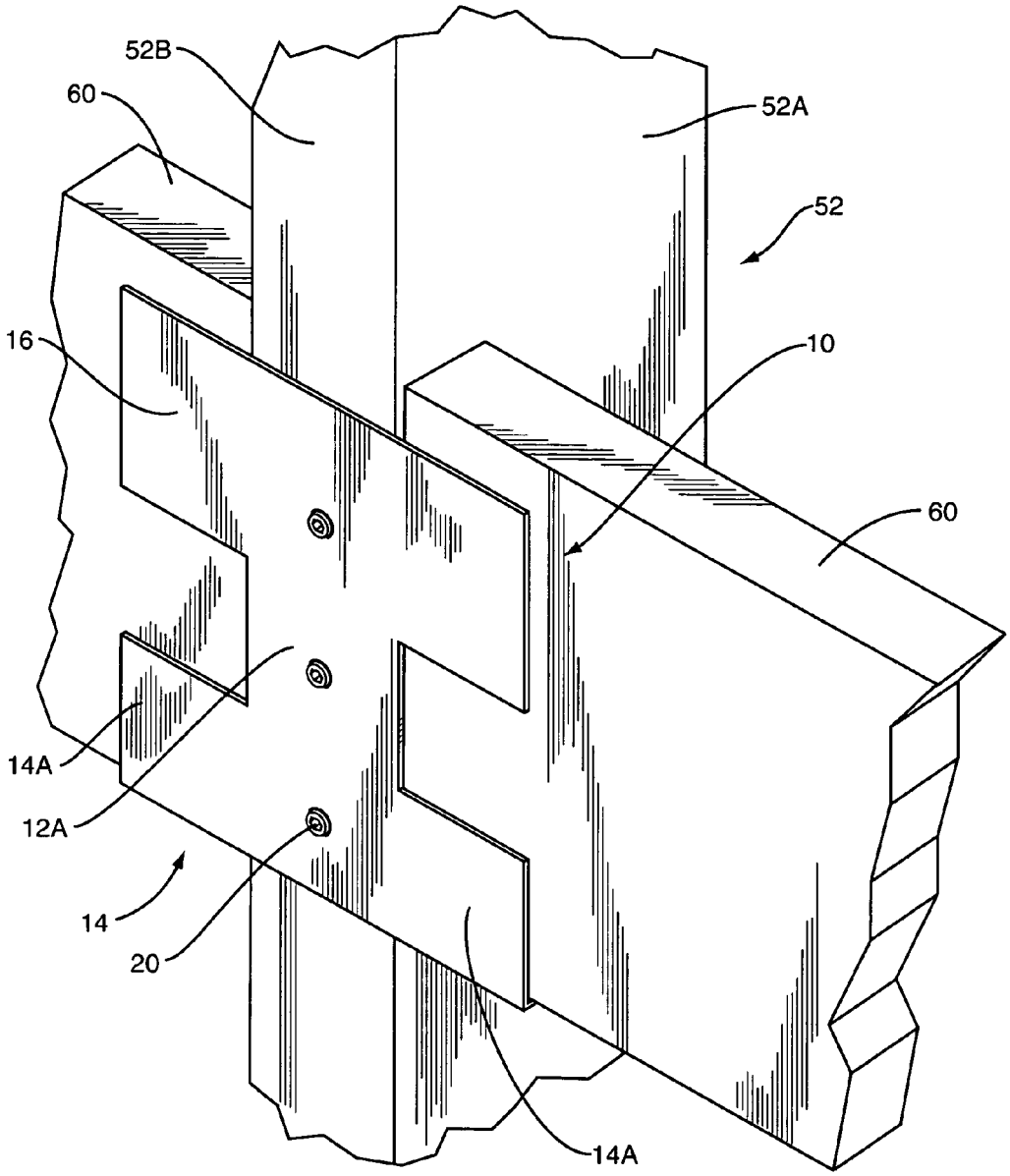
FIG. 2B is a fragmentary perspective view showing the stud bracket of FIG. 2A secured to a stud and supporting end portions of two reinforcing members.
Figure 3:
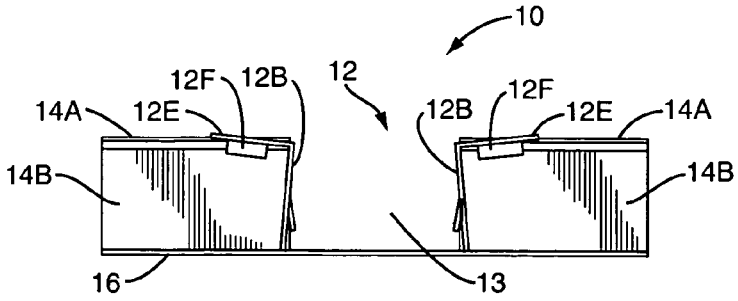
FIG. 3 is a top plan view of the stud bracket.
Figure 4:
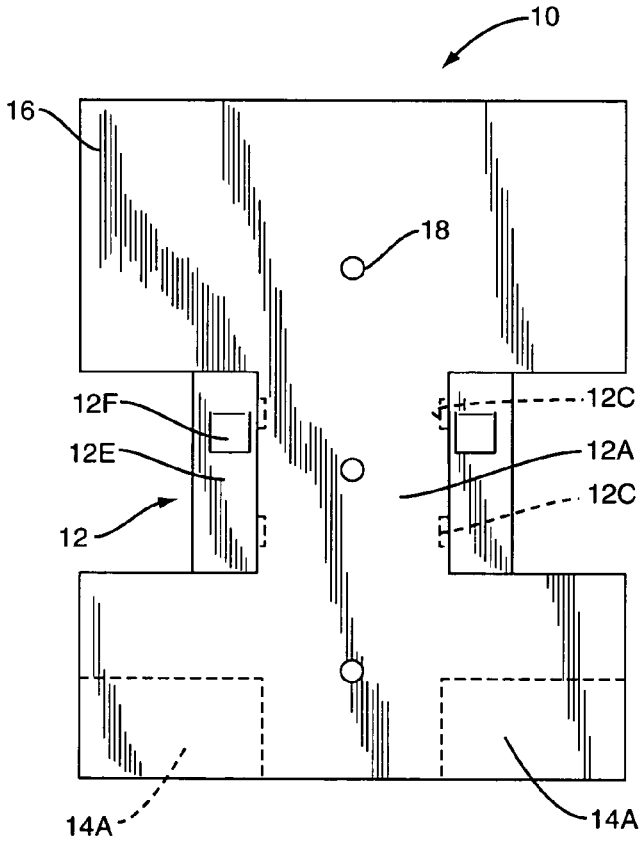
FIG. 4 is a front elevational view of the stud bracket.
Figure 5:
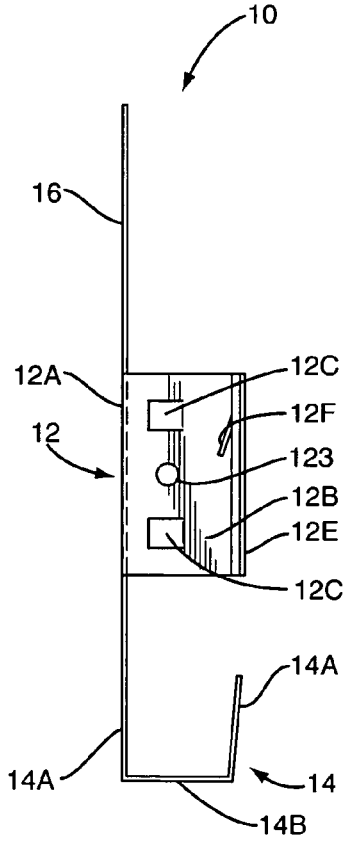
FIG. 5 is a side elevational view of the stud bracket.

The application or use of the bracket 10 shown in FIG. 2A is illustrated in FIG. 2B. Here the bracket 10 is secured to a stud 52, which can be a metal or wooden stud. Note that bracket 10 is designed to fit around flange 52B and a portion of the web 52A. Fasteners 20 are secured into the flange 52B. End portions of the reinforcing member 60, which may be a wooden plate or plank, are supported by the holders 14. As seen in FIG. 2B, the terminal end of each reinforcing member 60 is positioned such that it lies flush against the web 52A or a return that extends from the flange 52B or in the alternative terminates in close proximity thereto.

Figure 6:
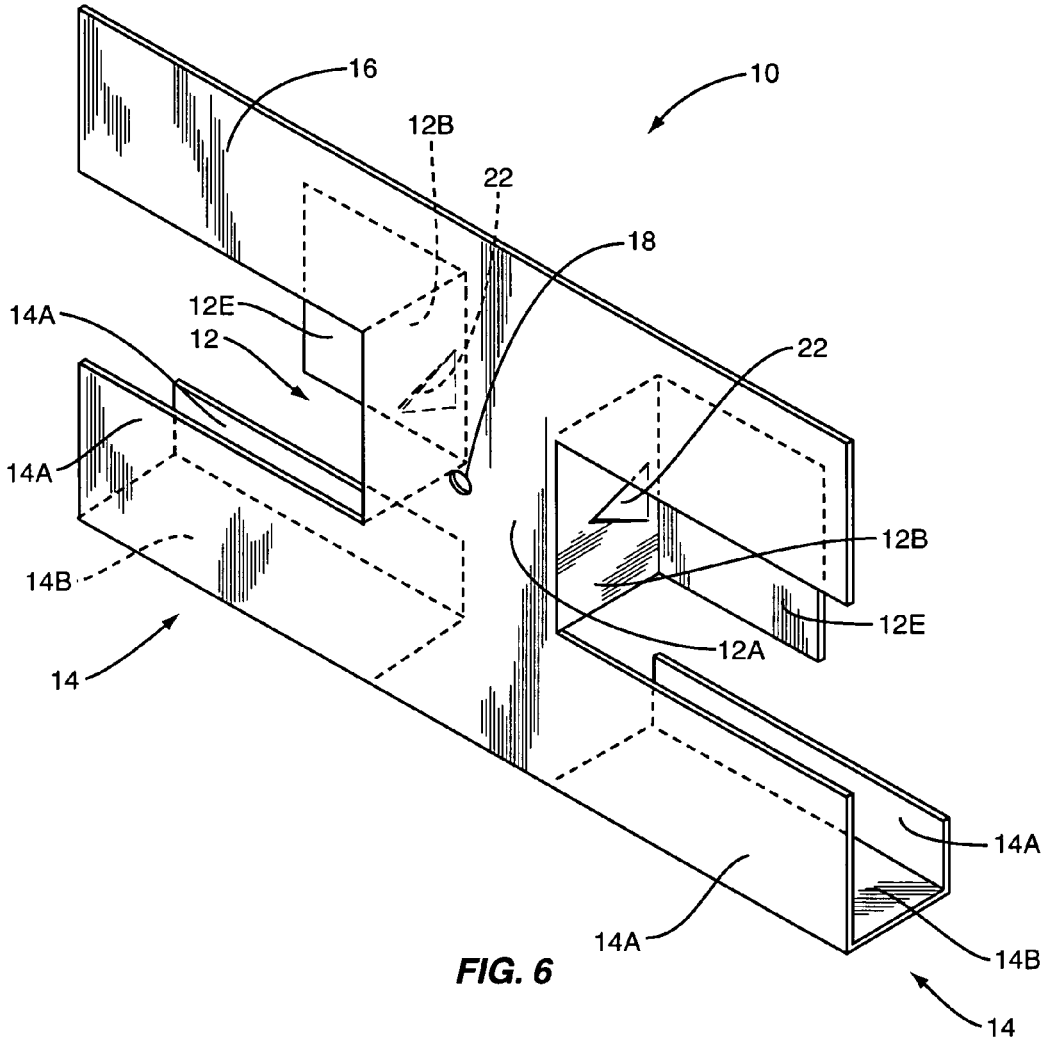
FIG. 6 is a perspective view of a second embodiment for the stud bracket.
Figure 7:
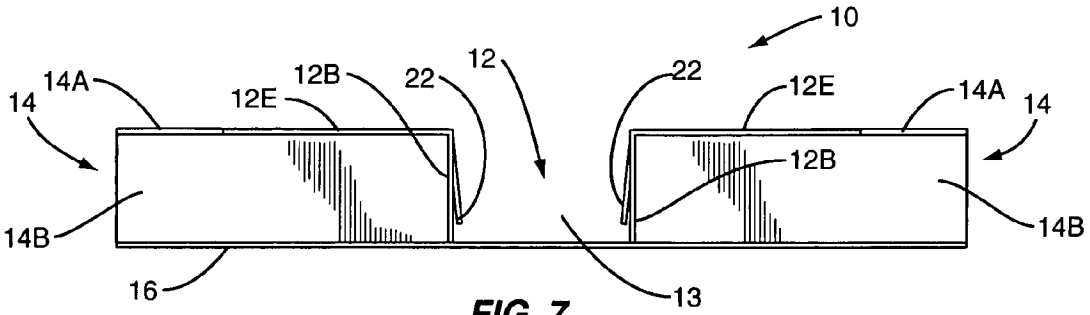
FIG. 7 is a top plan view of the stud bracket of FIG. 6.
Figure 8:
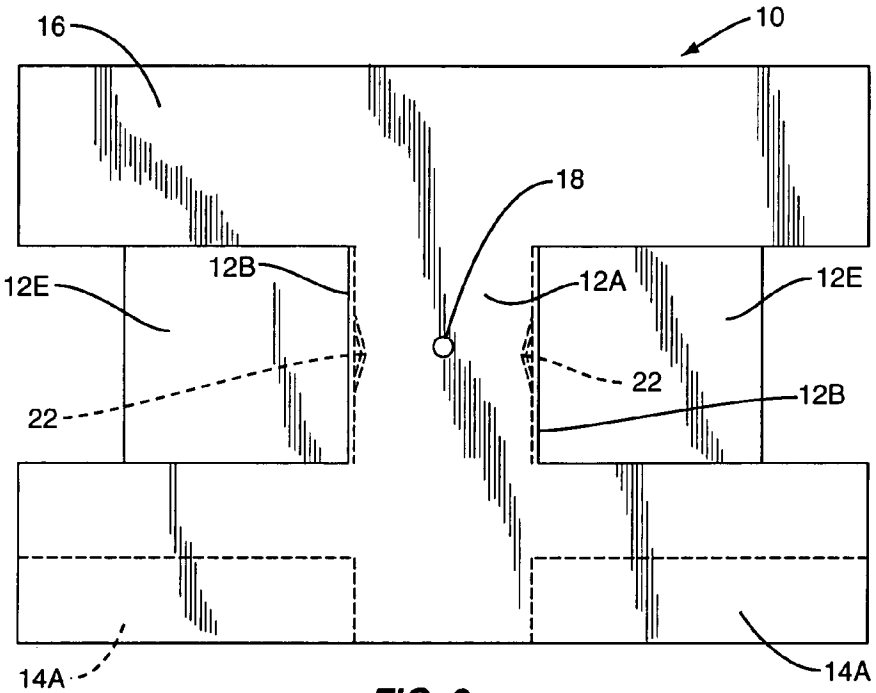
FIG. 8 is a front elevational view of the stud bracket of FIG. 6.
Figure 9:
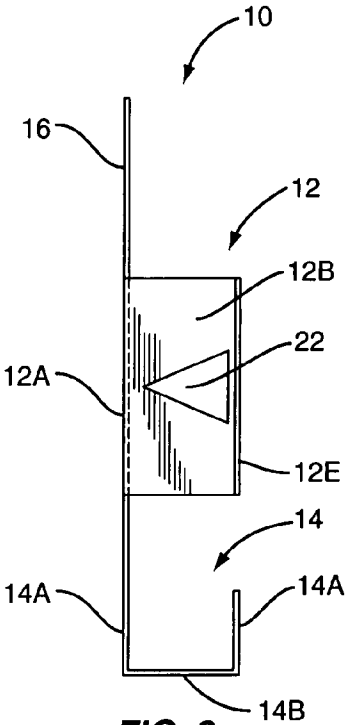
FIG. 9 is a side elevational view of the stud bracket of FIG. 6.

Turning to FIG. 6, a first alternative embodiment for the bracket 10 is shown therein. Structurally and functionally, the bracket 10 shown in FIG. 6 is similar to that described herein above with respect to FIGS. 2A-5. In the embodiment shown in FIG. 6, the flanges 12B of the stud receiver 12 include barbs 22. Barbs 22 assume a generally triangular shape and project inwardly towards the stud receiving area 13. Barbs 22 in the case of this embodiment are pointed such that they may dig into a wooden stud, for example, or engage portions of a metal stud. In any event, barbs 22 function to hold bracket 10 onto a stud 52 after the bracket has been inserted onto the stud. In many cases, the barbs 22 will function to temporarily hold the bracket 10 onto the stud until a fastener 20 can be extended through the fastener opening 18 to securely fasten the bracket to the stud.

Figure 10A:
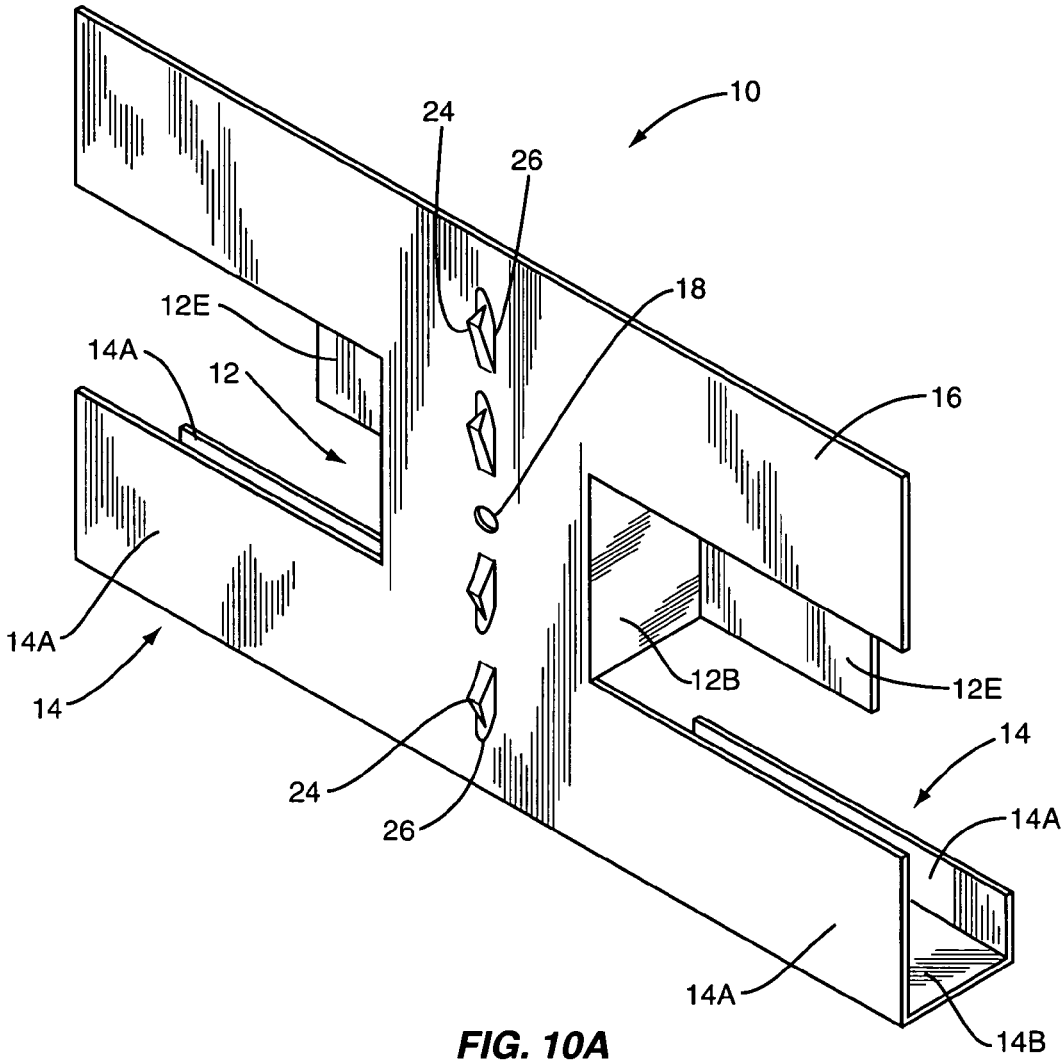
FIG. 10A is a perspective view of a third embodiment of the stud bracket.
Figure 10B:
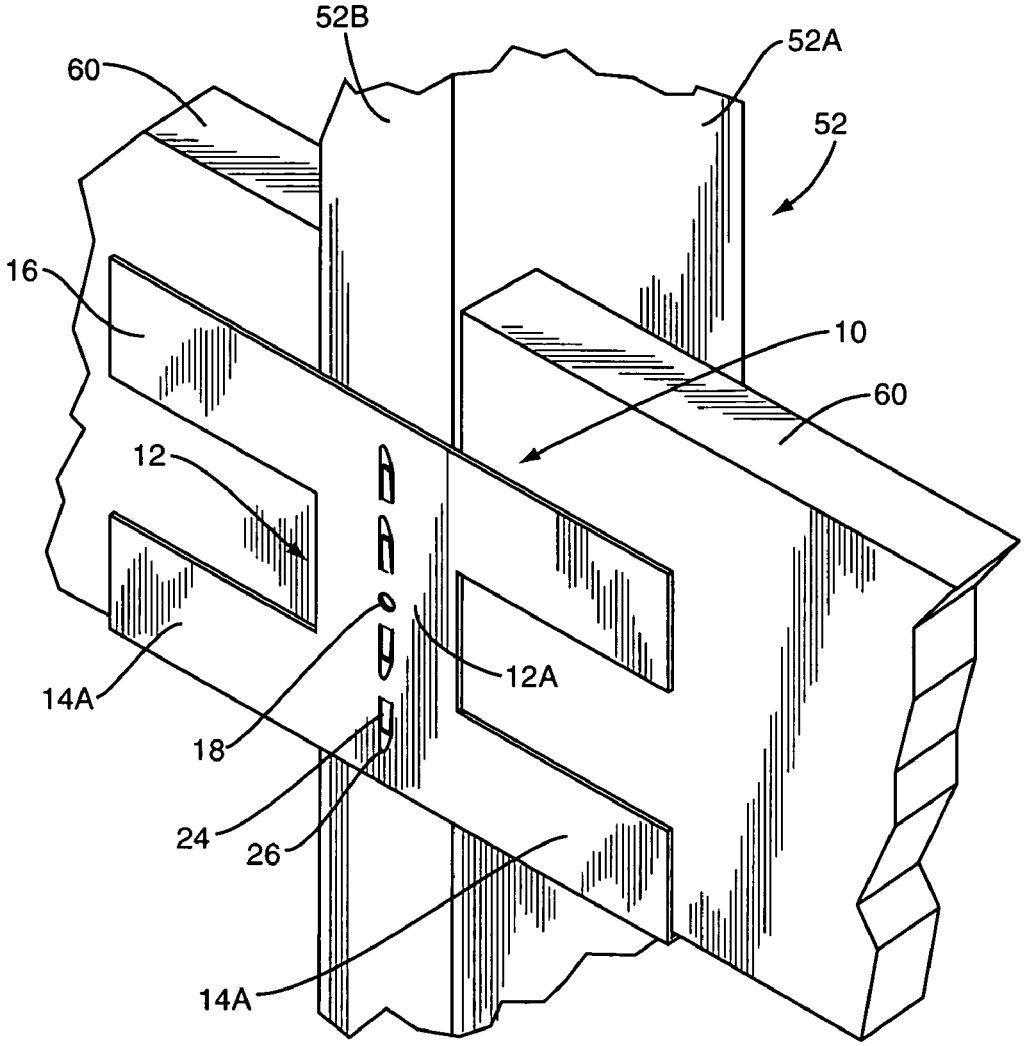
FIG. 10B is a fragmentary perspective view showing the stud bracket of FIG. 10A secured to a wooden stud.

FIGS. 10A and 10B illustrate a second alternative embodiment for the bracket 10. In this case, the face of the bracket 10 is provided with a series of spikes 24. This embodiment is particularly useful with a wooden stud. Spikes 24 are formed by cutting and shaping them. More particularly, spikes 24 are cut so as to form openings 26 and thereafter are bent such that each spike includes a point. Thus, when the embodiment shown in FIG. 10A is inserted onto a wooden stud, for example, the installer can hammer the respective spikes 24 into the adjacent edge of the wooden stud. Additional security can be achieved by utilizing a fastener 20 through the fastener opening 18 formed in the face of the bracket. FIG. 10B illustrates the bracket 10 of FIG. 10A secured to a wooden stud 52 and further illustrates a pair of reinforcing members 60 supported by the bracket 10.

Figure 11:
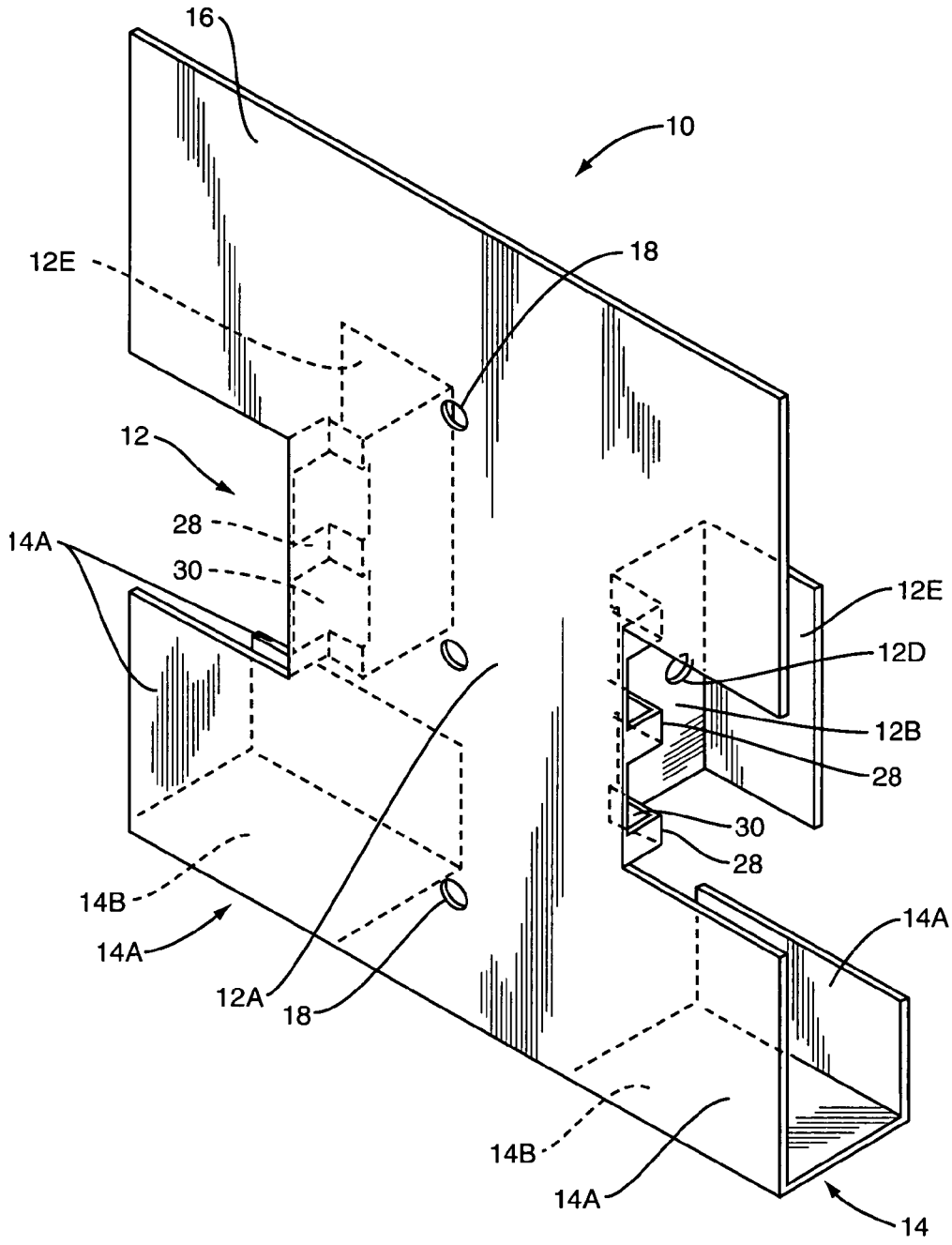
FIG. 11 is another alternate embodiment for the stud bracket.

Yet another alternative embodiment for the bracket 10 is shown in FIG. 11. The embodiment shown in FIG. 11 is similar to the embodiment shown and described herein before. However, there is provided an angled section 28 that forms a part of the flange 12B or forms an interface between the web 12A and each of the flanges 12B. This angled section 28 forms part of the stud receiver and projects from the web 12A. Openings or cutouts 30 are formed in the angled section 28. This permits the flanges 12B to be flexible and exhibit a spring-like characteristic. That is, the spacing between the flanges 12B can be such that in order to insert a stud 52 therebetween, the flanges 12B have to be moved apart. The openings 30 tend to facilitate the spreading of the flanges 12B to accept the stud 52. Once the stud 52 has been inserted between the flanges 12B, then the openings 30 tend to permit the flanges 12B to spring or be biased inwardly in which case the flanges 12B will apply pressure or force against the stud 52 held therebetween. Again, by utilizing the opening 12D formed in flanges 12B, a fastener can be utilized to secure the flanges and hence the bracket 10 to the butt end of the reinforcing member 60.

Figure 12:
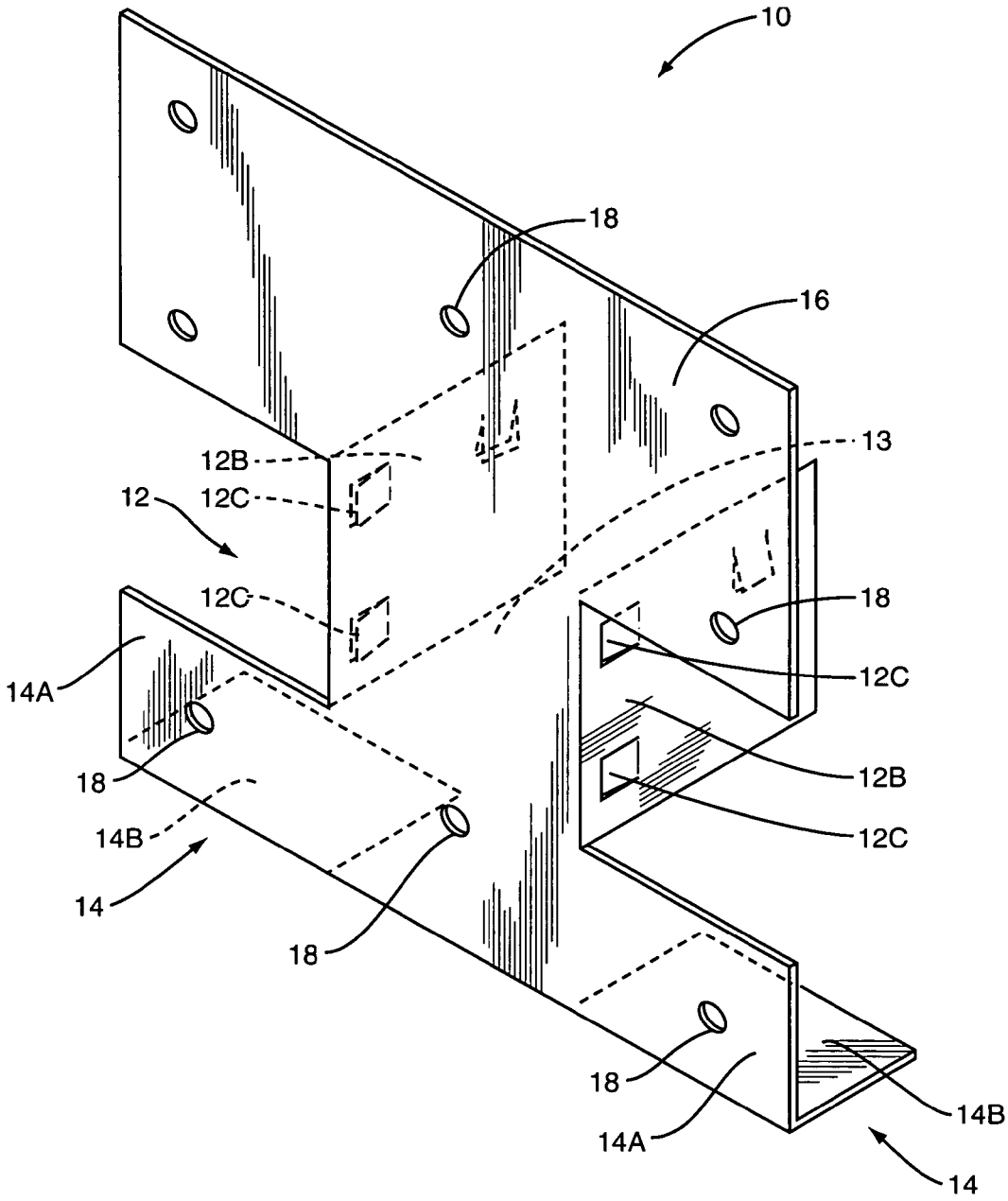
FIG. 12 is yet another alternate embodiment for the stud bracket.

Turning to FIG. 12, another embodiment for the stud bracket 10 is shown therein. In this embodiment, the stud bracket 10 is designed to accept both 1× and 2× lumber, instead of 1× lumber which is usually of a ¾" nominal thickness. In the FIG. 12 embodiment, compared to the FIG. 2A embodiment, the holder 14 does not include the back flange 14A. In addition, the flange 12B does not include the retainer or flange 12E shown in FIG. 2A. However, in some embodiments, the flange 12B of the FIG. 12 embodiment could be provided with a custom made retainer such as the retainer 12E shown in FIG. 2A. Note also in the case of the FIG. 12 embodiment, the provision of a series of openings 18 formed in the face of the bracket 10 to permit reinforcing members to be securely attached to the bracket 10.

Figure 1B:
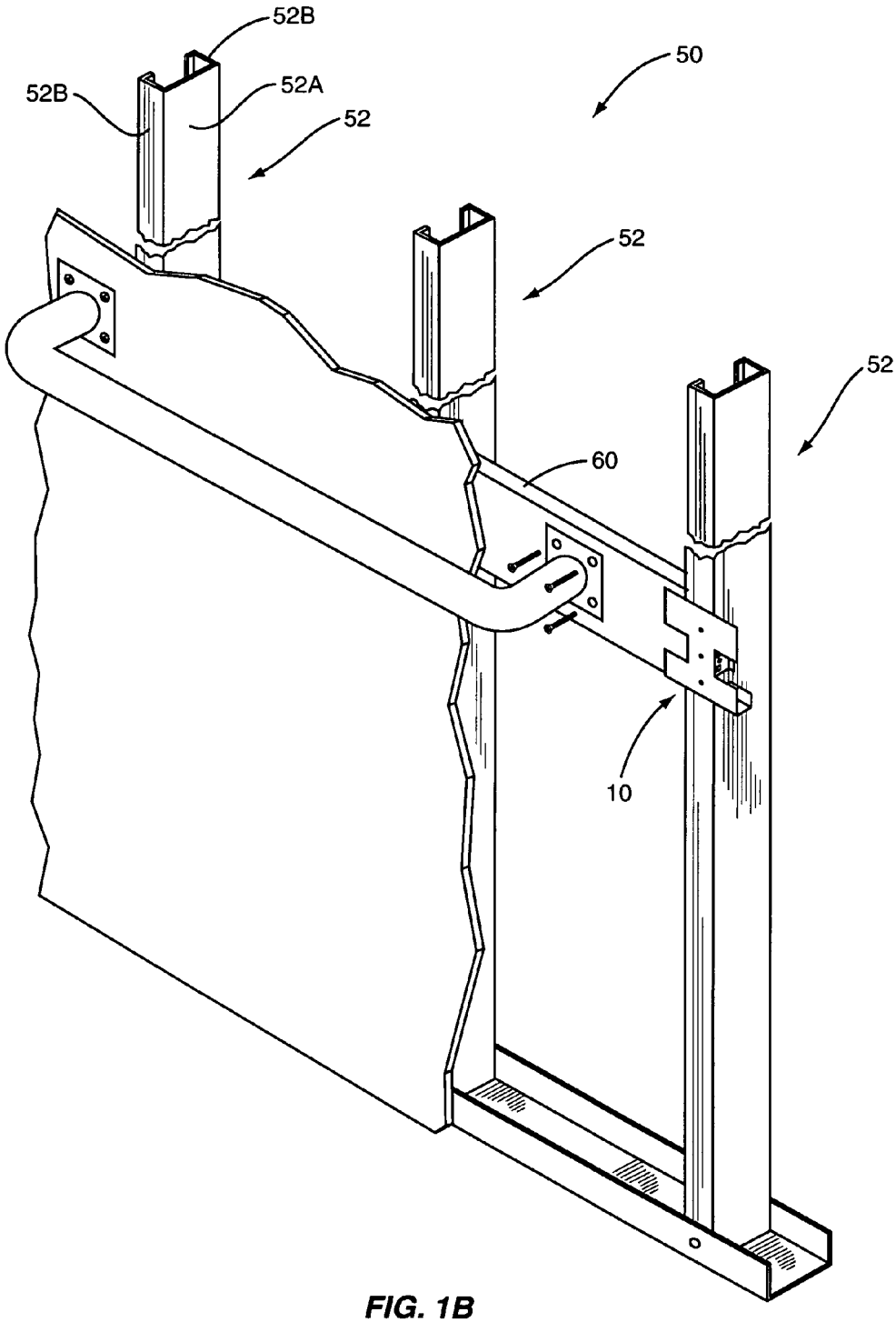
FIG. 1B is similar to FIG. 1A but illustrates a handrail secured to the reinforcing member.

FIG. 1A illustrates a series of brackets 10 being utilized in a wall structure designated generally by the numeral 50. Note that in this case, two reinforcing members 60 extend between the three studs 52 shown therein. Each reinforcing member 60 extends between two consecutive studs 52 and is held by the two spaced apart brackets 10. Drywall or other types of interior material or boarding is placed over the brackets 10 and secured to studs 52. Reinforcing members 60 in the form of wooden boards or planks having a nominal ¾" thickness, for example, is utilized as a reinforcing structure to secure handrails. That is, the handrail structure can be secured directly through the drywall or other interior wall material and into the reinforcing members 60.

There are many advantages to the stud brackets 10 of the present invention. They can generally be made from a single sheet of sheet metal of any appropriate gauge. The entire structure of the bracket can be cut from a planar piece of sheet metal and bent and formed into the configurations shown in the drawings. The structure and design of the stud receiver 12 allows for tolerances in studs. The holder 14 and the arrangement of the second retainer 12E also allows for tolerances in the reinforcing member 60.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A metal stud bracket for use in a wall structure for supporting one or more reinforcing members, comprising:

a. a metal stud receiver having a pair of spaced apart members that define a stud receiving area there between;

b. a pair of spaced apart and aligned holders projecting outwardly from opposite sides of the stud receiver for receiving and holding end portions of two aligned reinforcing members, the holders being configured with respect to the stud receiver to hold the reinforcing members in a generally longitudinally aligned relationship;

c. each holder including a bottom web, a pair of upstanding flanges, and an open top such that the holder may wrap around a bottom portion of the reinforcing members held therein; and d. a first retainer spaced from the holders and having opposed ends, each end projecting outwardly relative to the stud receiver, and wherein the stud receiver is disposed generally between the first retainer and the holder.

2. The stud bracket of claim 1 including a generally planar face.

3. The stud bracket of claim 2 wherein one of the upstanding flanges of each pair of holders and the first retainer form portions of the generally planar face.

4. The stud bracket of claim 1 wherein the stud receiver includes a web and two flanges, and wherein the web of the stud receiver extends between the first retainer and the holders.

5. The stud bracket of claim 1 wherein the stud receiver includes one or more flexible tabs for engaging a stud and at least partially assisting in retaining the stud bracket on the stud.

6. The stud bracket of claim 5 wherein the stud receiver includes a web and a pair of flanges and at least one flexible tab disposed on one of the flanges of the stud receiver for engaging a stud and at least partially assisting in retaining the stud bracket on the stud.

7. The stud bracket of claim 6 wherein each flexible tab is partially cut from a flange of the stud receiver and bent outwardly such that the tab can flex back and forth with respect to the flange of the stud receiver.

8. The stud bracket of claim 6 wherein the tab is disposed on a flange of the stud receiver and projects inwardly towards the stud receiving area formed between the two flanges of the stud receiver and wherein the tabs flex outwardly in response to a stud being inserted into the flanges of the stud receiver.

9. The stud bracket of claim 1 wherein the stud bracket includes at least one second retainer spaced from the first retainer and operative to retain a portion of at least one reinforcing member.

10. The stud bracket of claim 9 wherein the second retainer extends from the stud receiver.

11. The stud bracket of claim 10 wherein the first and second retainers are laterally spaced apart and wherein when the stud bracket is vertically oriented at least a portion of the first and second retainers are vertically spaced apart.

12. The stud bracket of claim 1 wherein the stud receiver includes a web and a pair of flanges and at least one tab disposed on one flange for engaging a stud when the stud is inserted into the stud receiver; each holder comprising a generally U-shaped channel having a web and a pair of flanges, each channel projecting outwardly from the stud receiver; wherein the web of the stud receiver lies generally in the same plane as the first retainer and one of the flanges of each of the generally U-shaped channels; and including a second retainer projecting outwardly from each flange of the stud receiver and positioned to at least partially retain one reinforcing member.

13. The stud bracket of claim 1 wherein the stud bracket includes a generally I-shaped face wherein portions of the stud receiver, holders, and the first retainer form portions of the I-shaped face.

14. The bracket of claim 1 wherein the stud receiver includes one or more cutouts that impart a spring characteristic to the stud receiver.

15. The bracket of claim 1 wherein the stud receiver includes a web and a pair of flanges, and wherein there is provided one or more cutouts disposed generally between the web and at least one of the flanges.

16. A metal stud bracket for use in a wall structure for supporting one or more reinforcing members comprising: a generally I-shaped planar front including an upper generally flat transverse retainer; a lower generally flat transverse flange; a generally flat intermediate panel extending between the retainer and the lower transverse flange; a pair of openings disposed on opposite sides of the intermediate panel and extending between the retainer and the first flange; wherein the retainer, flange and intermediate panel all lie in substantially the same plane; a pair of second and third flanges projecting rearwardly from the I-shaped planar front with the second and third flanges extending generally perpendicular to the I-shaped planar front panel, wherein the second and third flanges project from the intermediate panel and lie between the retainer and first flange and wherein the second and third flanges define a stud receiving area along a backside of the generally I-shaped planar front; a first web projecting rearwardly from the first flange and disposed generally perpendicular to the first flange and a fourth flange projecting upwardly from the first web such that the first web and fourth flange lie generally perpendicular to each other; a second web projecting rearwardly from the first flange and generally perpendicular thereto; a fifth flange projecting upwardly from the second web and extending generally perpendicular to the second web; and wherein the first flange along with the first and second webs and the fourth and fifth flanges form a pair of spaced apart and aligned holders for receiving and holding two aligned reinforcing members; and wherein the first and second webs and the fourth and fifth flanges are spaced apart and lie generally below the second and third flanges that define the stud receiving area.

* * * * *